US006592300B2

(12) United States Patent
Yang et al.

(10) Patent No.: US 6,592,300 B2
(45) Date of Patent: Jul. 15, 2003

(54) PILE APPARATUS AND CONSTRUCTION PROCESS OF PLACING CONCRETE PILE IN GROUND

(75) Inventors: Won-Hoi Yang, Seoul (KR); Ho-Sang Lee, Seoul (KR)

(73) Assignee: C. S. Kim and Associates, Seoul (KR)

( * ) Notice: Subject to any disclaimer, the term of this patent is extended or adjusted under 35 U.S.C. 154(b) by 0 days.

(21) Appl. No.: 09/995,046

(22) Filed: Nov. 27, 2001

(65) Prior Publication Data

US 2003/0021637 A1 Jan. 30, 2003

(30) Foreign Application Priority Data

Jul. 25, 2001 (KR) ..... 2001-0044782

(51) Int. Cl.[7] ..... E02D 5/34; E02D 7/02

(52) U.S. Cl. ..... 405/241; 405/239; 405/240; 405/251; 405/253

(58) Field of Search ..... 405/236–245, 405/249, 251, 253, 257

(56) References Cited

U.S. PATENT DOCUMENTS 2,576,507 A * 11/1951 Gerwick, Jr. ..... 405/240
3,499,293 A * 3/1970 Kato ..... 405/241
3,869,869 A * 3/1975 Pao Chen ..... 405/240

FOREIGN PATENT DOCUMENTS

JP 9273148 10/1997

* cited by examiner

*Primary Examiner*—Thomas B. Will
*Assistant Examiner*—Tara L. Mayo
(74) *Attorney, Agent, or Firm*—Howard & Howard

(57) ABSTRACT

A concrete pile construction method and an apparatus used for improving soft earth ground by constructing reinforced bar concrete pile structures in the earth. The purpose of the present invention is to provide a process for securing firm concrete piles having a reinforced bar core with uniform concrete by a pile apparatus in which projections are radially formed and a conical-shaped bit is formed pointedly on the pile apparatus.

19 Claims, 8 Drawing Sheets

PILE APPARATUS AND CONSTRUCTION PROCESS OF PLACING CONCRETE PILE IN GROUND

RELATED APPLICATIONS

This application claims priority to Korean Patent Application No. 2001-0044782, filed on Jul. 25, 2001.

FIELD OF THE INVENTION

The present invention relates to a piling apparatus and a process for the purpose of improvement of soft-ground earth in which buildings and marine structures are built thereon.

DESCRIPTION OF THE PRIOR ART

In the prior art, there has been provided injection holes having a desired diameter and depth for constructing a reinforced bar concrete pile in the earth. The purpose of which is to improve the existing soft-ground. In this case, reinforced bars are charged into concrete injection holes, and concrete is injected, filled, and stamped. Finally, through curing, the reinforced bar concrete pile is constructed.

Until now, Pedestal pile, Franki pile, Beneto pile, Calweld, Reverse circulation method, etc., have been used for forming injection holes for concrete.

However, there have been problems such as unevenness of an inner peripheral surface of the concrete injection holes, which causes a position of the reinforced bars that are inserted or arranged therein to become irregular and uneven resulting in very low reliability of strength of the concrete pile deposited therein. For this reason, secure and reliable methods and devices for piling construction have been requested.

Therefore, there is a need in the art to provide a method and an apparatus for reinforcing concrete pile structures in which the reinforced bar is evenly sunk in the soft-ground earth.

SUMMARY OF THE INVENTION AND ADVANTAGES

The pile apparatus of the present invention basically comprises a tube rod having duplicated tubes of concentric circles of large and small diameters, and a conical bit on which diamond shaped projections are formed. The above bit is vertically penetrated in the earth with vibration which is exerted during the concerned piling works. Reinforced concrete bars bundled into a desired shape, is charged into the earth through the space of the smaller diameter inner tube and kneaded concrete is supplied through an injection hose in the desired spot of the earth by vibration. Then, the above pile apparatus is drawn up slowly with vibration, and concrete, injected through the injection hose, fills up spaces and clearances between the projections and inner wall of the pile apparatus.

DETAILED DESCRIPTION OF THE PREFERRED EMBODIMENT

The present invention is described in detail hereunder, referring to the embodiments illustrated in the attached drawings.

Figure 1:
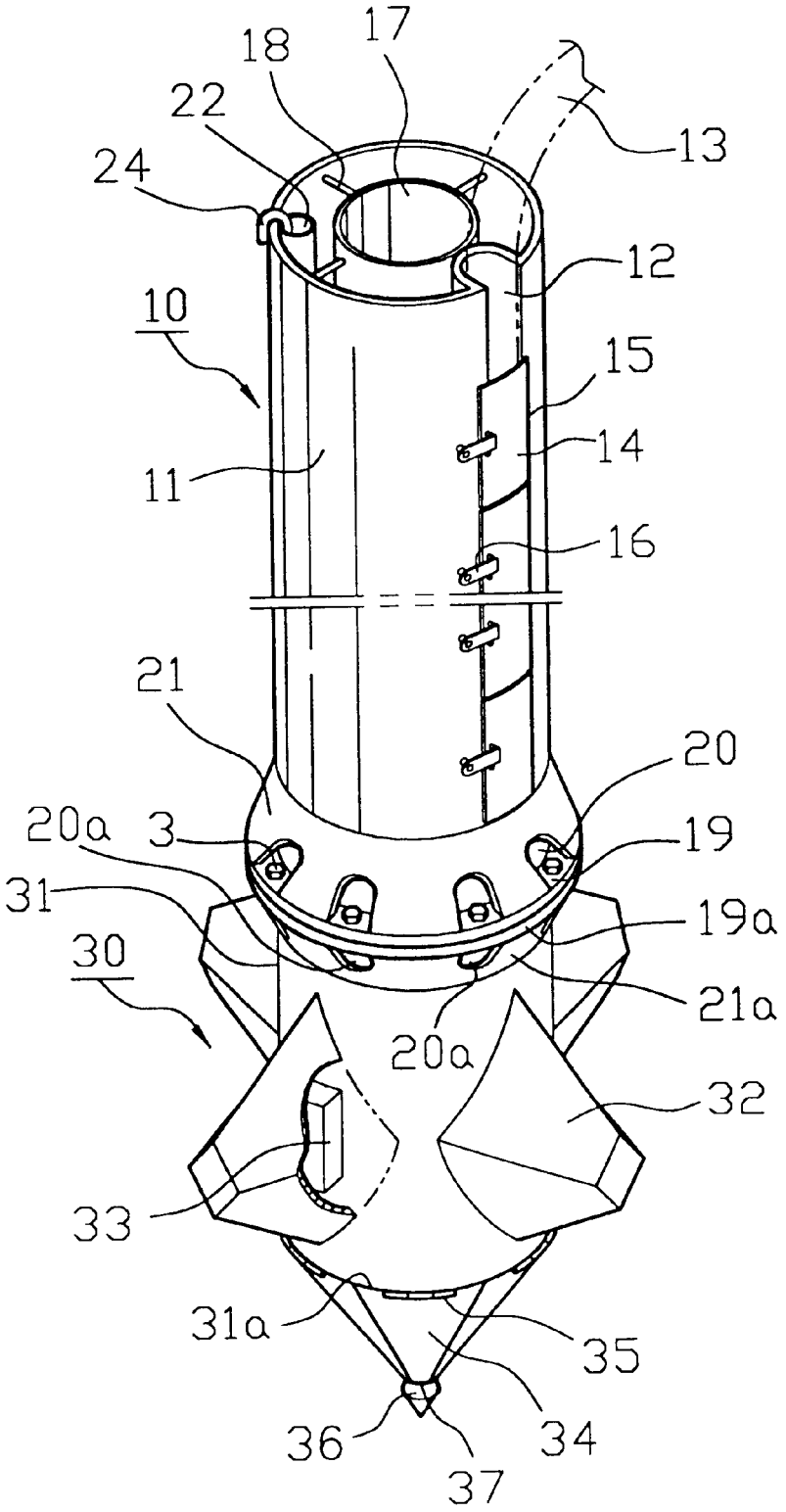
FIG. 1 is a perspective view of an embodiment of a concrete pile apparatus in accordance with the invention.
Figure 2:
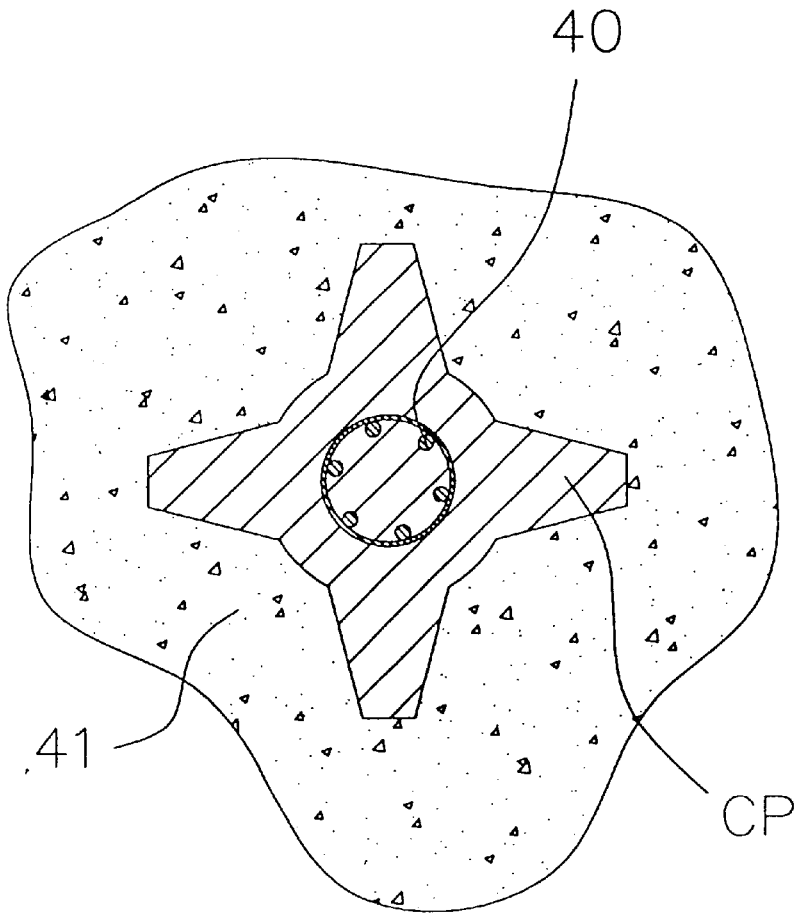
FIG. 2 is a cross sectional view of the concrete pile constructed in the earth, after solidification of concrete injected through a concrete injection hose of the invention.
Figure 3:
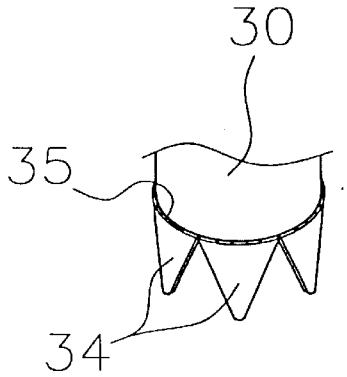
FIG. 3 is a partial view of an opened state of triangle segments each having a triangular shape in the lowest end of the concrete pile apparatus in accordance with the invention.
Figure 4:
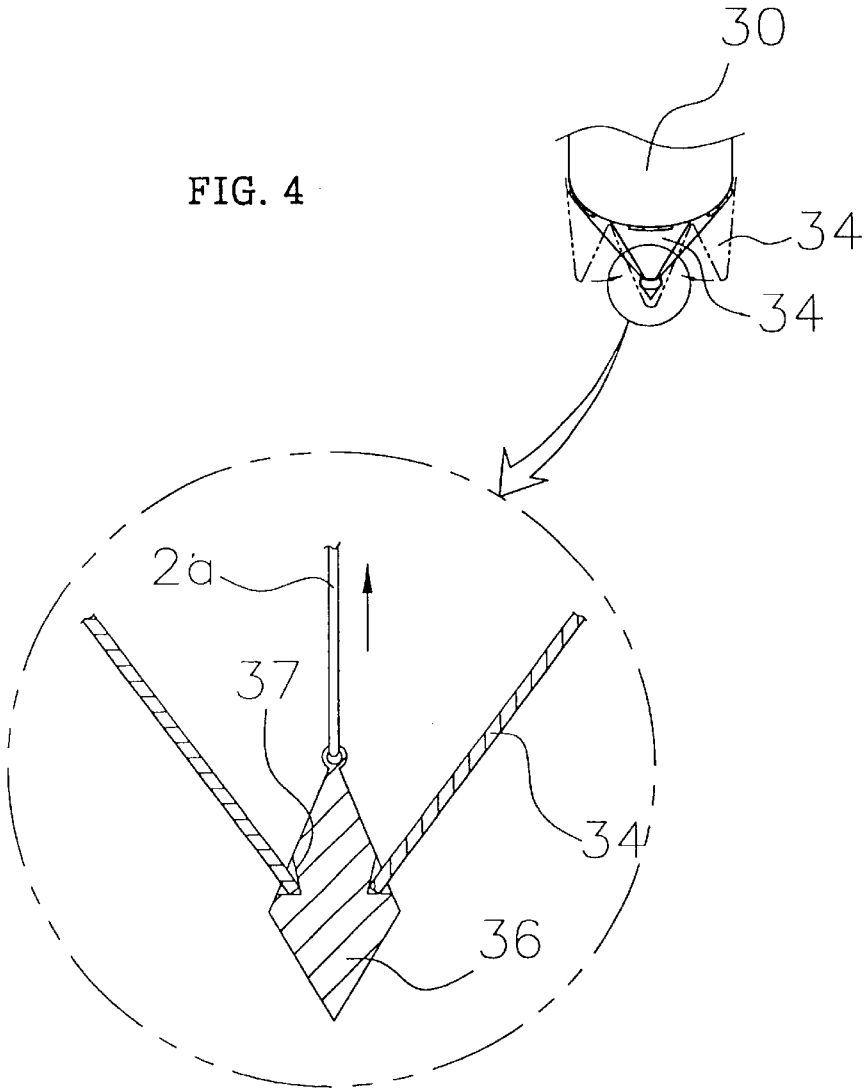
FIG. 4 illustrates conically closing the bit and an end part of each segment which is engaged in the groove formed in the metallic weight at the lowest position of the bit.

The present invention provides a reinforced bar concrete pile construction apparatus 1 that includes a tube rod 10 and a bit 30 as in FIG. 1, for forming a reinforced bar concrete pile CP. The apparatus will be herein referred to as simply the pile apparatus 1. The bit 30 includes projections 32 that are radially protruding therefrom. The pile apparatus 1 includes a hollow spaced tube rod 10 on which a grooved channel 12 is inwardly and longitudinally formed along the outer wall surface thereof. An inner tube 17 is concentrically fixed to an outer tube 11 of the same length, having lattices 18 connected and welded thereto. The outer tube 11 is part of the tube rod 10 such that the outer wall surface of the tube rod 10 is an outer wall surface of the outer tube 11. A concrete injection hose 13 is inserted in the grooved channel 12 and is movable upward and downward in the grooved channel 12. A door plate 14 is pivotally hinge-jointed 15 for covering the grooved channel 12 and for retaining the injection hose 13. Latches 16 are attached at the left side of the tip portion of the grooved channel 12 for opening and closing the door plate 14 over the channel 12. The pile apparatus includes a hanger retaining channel tube 22 disposed between said tube rod 10 and said inner tube 17 inside which a hanger chain 2*a* is connected to a coil spring 23 and a hook 24. The hanger chain 2*a* is moved like a rope up and down therein. The pile apparatus includes flanges 19, 19*a* having a plurality of through-holes (not shown) therein for bolting or securing the tube rod 10 and the bit 30. An upper metal sheet cover 21 having pitted grooves 20, and an inclined surface extends from the outer wall of the tube rod 10. A lower metal sheet cover 21*a* having pitted grooves 20*a* and inclined surfaces extends from the outer wall 31 of the bit 30.

The bit 30 defines a hollow space 30*a*. The bit 30 on which the projections 32 are formed is to be assembled to the tube rod 10 by the flange fixing means previously described.

The projections 32 have inclined surfaces that create a symmetrically formed diamond-shape. The projections are positioned on the bit 30 and are symmetrically formed about the bit 30. Vibrators 33 are included in an inner space of the projections 32.

Triangle segments 34 have a triangular shape and are pivotally mounted to the outer wall 31 of the bit 30 by being hinge-jointed to the outer wall 31 of the bit 30. The triangle segments 34 are attached adjacent to a lower peripheral portion 31*a* of the bit 30.

A metal weight 36 includes grooves 37 that are formed in the outer peripheral surface thereof. The metal weight 36 is connected to the hanger chain 2*a* extending to the spring 23 of the hook 24, for engaging and moving the above said triangle segments 34 at lower end portions of the triangle segments 34.

As described above, the concrete pile apparatus 1 includes the hollow tube rod 10 as an upper part and the bit 30 as a lower part, and these parts are fastened and assembled by fastening means such as bolts 3 fastening the flanges 19,19*a* of the tube rod 10 and the bit 30.

Figure 8:
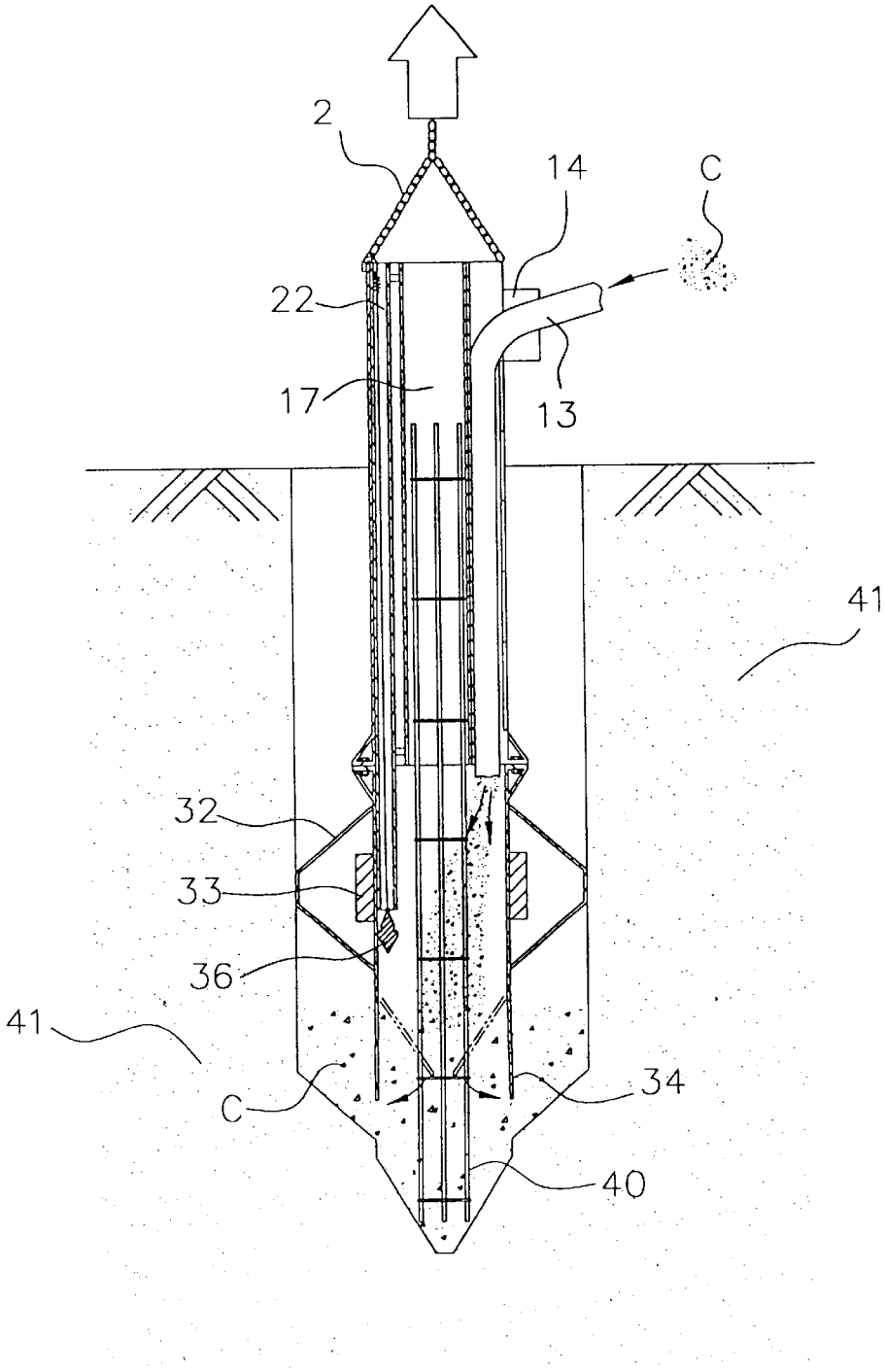
FIG. 8 is a longitudinal section view which shows injecting and filling the concrete to spaces formed in the earth. Then, the apparatus is drawn up slowly soon after the injection of the concrete.

This grooved channel 12 securely embraces the concrete injection hose 13 as in FIG. 1 and FIG. 8. As in FIG. 1, the door plates 14 are placed on the outer peripheral wall of the tube rod 10 at left and right sides of a tip portion of the grooved channel 12 for covering the grooved channel 12. The door plates 14 include hinge-joints 15 and latches 16 attached at right and left sides of the tip portion respectively and the door plates 14 are opened or closed by the latches 16 thereon. Inside the tube rod 10, the inner tube 17 having a smaller diameter than that of the outer tube 11, and having both ends open, is concentrically fixed by the lattices 18 welded to an inner wall of the outer tube 11 of the tube rod 10.

On the outer peripheral wall of the lowest portion of the tube rod, the flange 19 having through-holes for fastening the bolts 3 therein, is provided with the pitted grooves 20 in which a spanner for fastening the bolts, can be used. The upper steel cover 21 is attached with some gradient, to the tube rod 10, and an end portion of the flange 19*a* secured to flange 19 is fixed and engaged with that of the bit 30.

On the outer peripheral wall 31 of the bit 30, the projections 32 (there are four projections as an example in FIG. 1) having four inclined surfaces, like diamond-shapes, on the outer wall of the bit, are formed. Each projection 32 thereon is radially protruded for forming a homogeneous structure of the concrete pile in the earth 41. This pile apparatus in which the bit 30 is installed in the lower end of the tube rod 19, is descended and piled in the earth, by vibration generated by the vibrators 33.

A reinforced concrete bar structure 40 is descended through the inner tube 17 of the pile apparatus 1, settled in the earth and then, concrete is injected through the injection hose 13 accompanied by continuous vibration, so that concrete is homogeneously mixed and filled in the space of the soft-ground earth created by exertion of the projections 32 having the vibrators 33 therein, then the pile apparatus 1 is drawn up from the earth.

Figure 5:
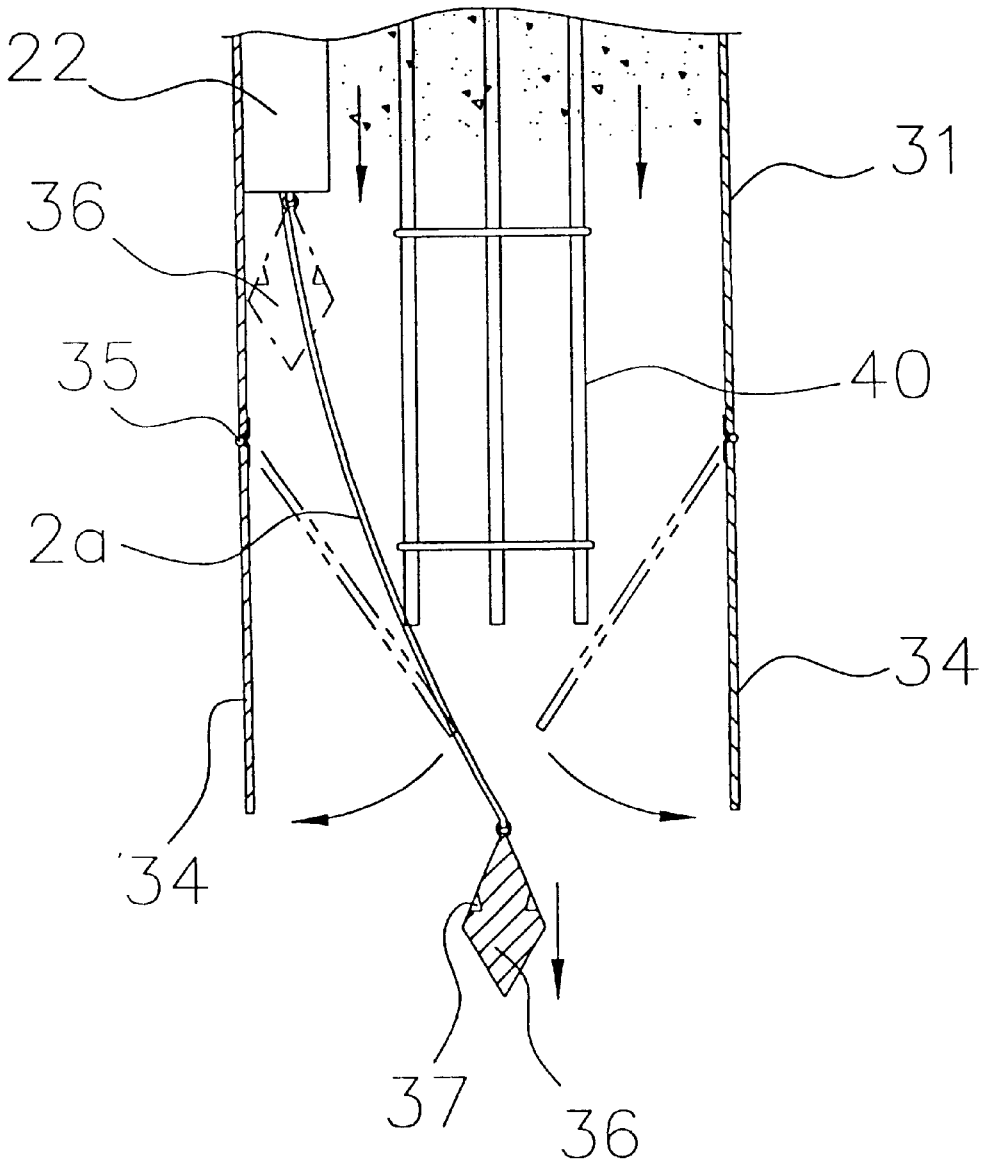
FIG. 5 is a sectional view of the inside of the bit of the present invention for illustrating that each segment can be pivotally jointed and moved in the directions shown, and the reinforced bar is descended to the earth, and thereafter, concrete is injected through the injection hose into the soft-ground earth.
Figure 6:
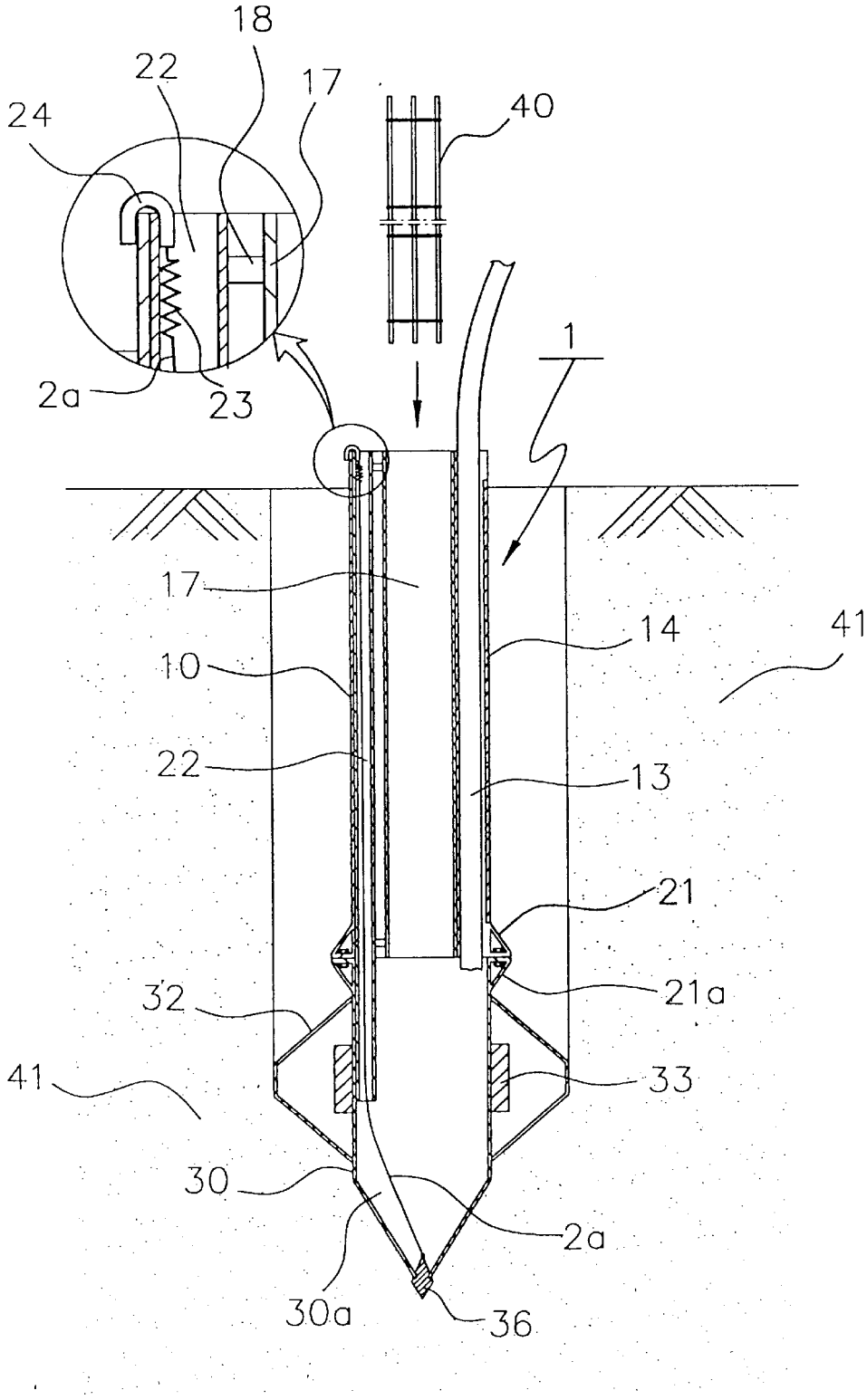
FIG. 6 is a longitudinal section view of the concrete pile apparatus of the present invention, sunk by vibration of vibrators provided in the projections of the bit, which exerts vibrations successively during the work. This shows that the bit of the pile apparatus is in a closed state in the lowest position.
Figure 7:
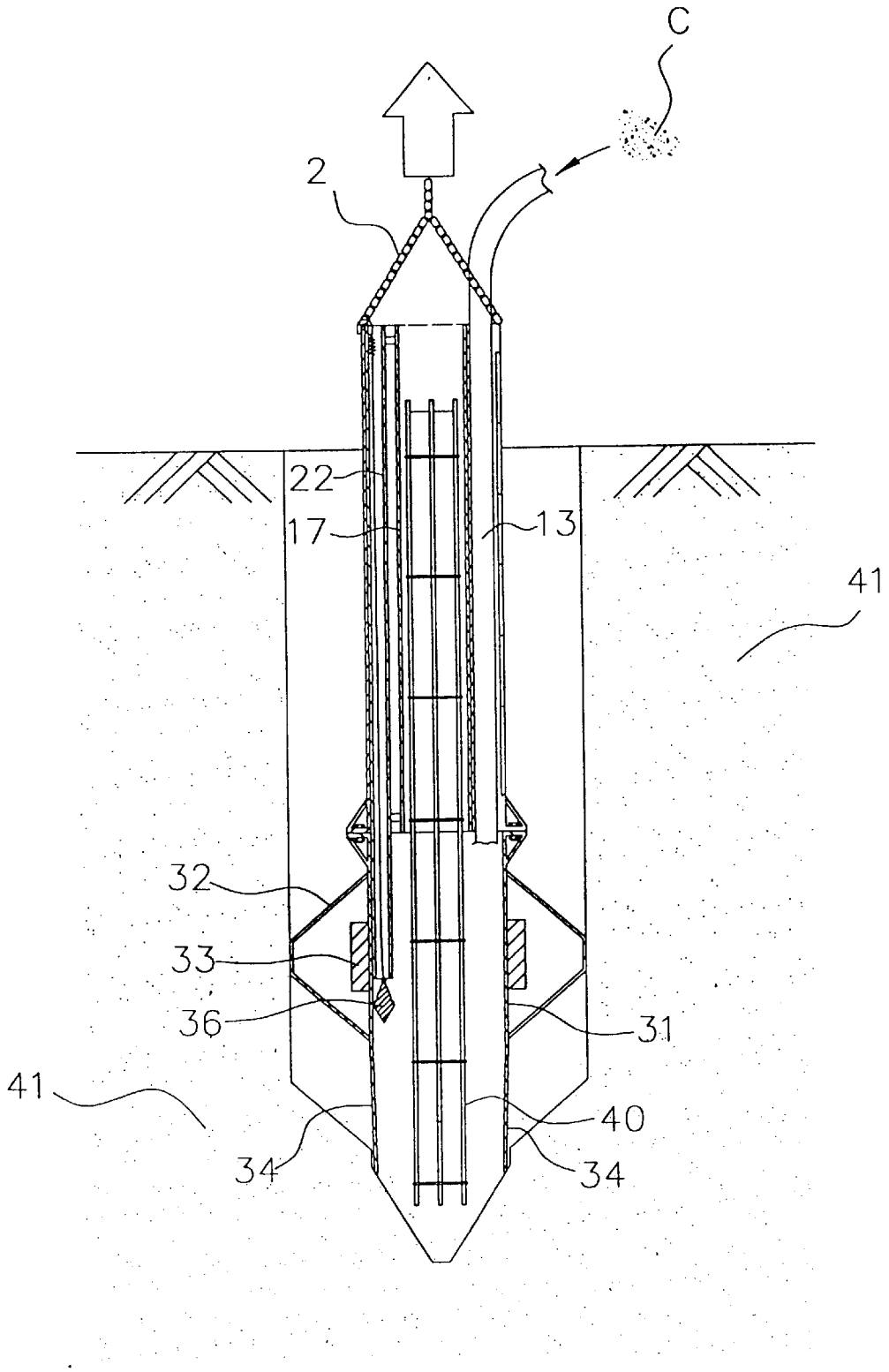
FIG. 7 is a longitudinal section view prior to injection of the concrete through the injection hose. In this case, reinforced bars are inserted in the inner tube fixed in the inner wall of the outer tube of the tube rod, and also are penetrated in the soft-ground earth with vibration.

At a lower tip portion of the bit 30, the triangle segments 34 are positioned in a closed state as shown in FIG. 6 and FIG. 7 when the lower end portions of the triangle segments 34 are engaged in the grooves 37 of the metallic weight 36 thereby forming a conical shaped lower tip portion. The triangle segments 34 can also be positioned in an opened state as shown in FIG. 5 and FIG. 8 when released from the grooves 37 of the metallic weight 36.

Each triangle segment 34 that is hinge-jointed to the outer wall 31 of the bit 30 and engaged in the grooves 37 of the metallic weight 36 in the closed state, pivotally moves when opened to the opened state. The triangle segments 34 are released from the metallic weight 36 and swing toward a side wall of the bit 30 when the reinforced bar structure 40 descends downward and engages the triangle segments 34 and the hanging hook 24 is removed from the tube rod 10. This action releases the tension from the hanging chain 2*a*.

The triangle segments 34 can be released from the grooves 37 of the metallic weight 36 in a number of ways. The hanger chain 2*a* is connected to the metallic weight 36. Therefore, it is important to release the tension in the hanger chain 2*a* or force the triangle segments 34 from the grooves 37 to release the triangle segments 34 from the metallic weight 36. In another manner, the reinforced bar structure 40 could be lowered and load the triangle segments 34 thereby pulling the hanger chain 2*a* downward until the triangle segments 34 are released without removing the hanging hook 24. The reinforced bar structure 40 could also be in place and the triangle segments 34 released as the pile apparatus 1 is ascended upward in much the same manner as previously described. Furthermore, the hanging hook 24 can be removed from the tube rod 10 and slack provided in the hanger chain 2*a* such that when the pile apparatus 1 ascends, the triangle segments 34 are released by gravity and pivot toward the side. In addition, it should be appreciated that any combination or variation of these methods could be used and the manner in which the metallic weight 36 is not intended to limit the present invention.

Here, after release of the triangle segments 34, each segment 34 moves to the side wall in the direction shown in FIG. 5 and the hanging hook 24 is moved upward again for its hanging in the upper end of the tube rod 10, and the metallic weight 36 is engaged upward in the end of the channel tube 22, by restored elastic power of the coil spring connected to the hanger chain 2*a*. Thus, the overall structure of the preferred embodiment of the concrete pile apparatus for movement of the soft-ground earth is described.

Before practicing concrete pile construction work by the pile apparatus 1 of the present invention, the bit 30 is selected for its diameter and assembled to the tube rod 10 which is suspended by a hanger 2 connected crane, which is done by matching the lower flange 19*a* of the bit 30 and the upper flange 19 of the tube rod 10 by bolting in the pitted grooves 20, 20*a*.

The above pile apparatus 1 is to be fully penetrated in the soft-ground earth by driving or descending the pile apparatus 1 to a target level. When it penetrates down to the target level, then the reinforced bar structure 40 of which the bars are bundled with the same length to that of the concrete pile, is charged into the inner tube 17. Then, it is to be positioned at the bottom of the soft-ground earth from the inner peripheral surface of the inner tube 17.

After settlement of the reinforced concrete bar, then concrete is injected with vibration of vibrator 33 and successive vibration is offered on the tube rod 10 and on the bit 30, and continues when drawing up the apparatus. In this case, the triangle segments 34 are rotatably moved sideward prior to the above operation, and the hanger chain 2*a* is drawn upward through the hanger retaining tube 22 and also the metallic weight 36 is drawn up, as shown in FIG. 8.

After drawing up the pile apparatus, the hanging hook 24 is manually released from the upper end of the tube rod 10 and the hanger chain 2*a* is drawn downward and the triangle segments 34 are again engaged in the grooves 37 of the metallic weight 36 to be ready to start piling work.

When the triangle segments 34 are moved from the closed state to the opened state, concrete is discharged through the injection hose 13 and filled in spaces of the soft-ground created by the diamond-shaped projections 32 formed on the outer peripheral surface of the bit 30 and connected to an inner space of the earth created by the remaining portions of the piling apparatus 1.

Figure 9:
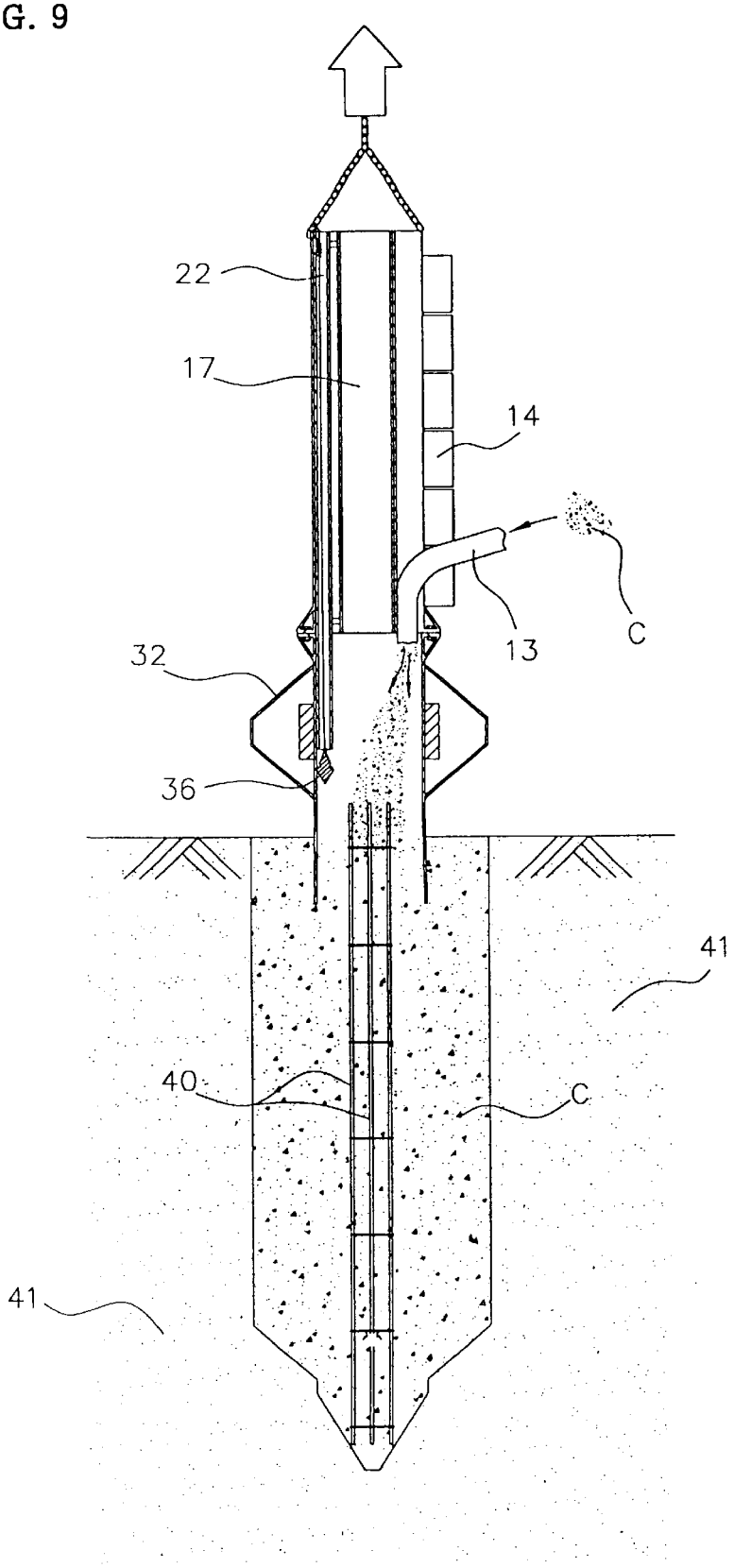
FIG. 9 is a longitudinal section view which shows that the pile apparatus is completely drawn up, and the reinforced bar remains in the solidified pile of the concrete formed in the earth.

The tube rod 10 of the pile apparatus 1, inner tube 17 and the bit 30, is then ascended or drawn upward, and the reinforced bar structure 40 in the inner tube 17, remains in the inner space of the earth. The concrete C is then discharged from the bit, filled and stamped with vibration in the spaces in the soft-ground earth. In this manner, as illustrated in FIG. 9, the pile apparatus 1 which slowly ascends upward creates a homogeneous concrete pile in which the reinforced bar remains. After the pile apparatus 1 is removed, the reinforced bar concrete pile CP thus formed includes a circular column 40, and multiple columns of radial protrusions which have smooth and homogeneous load distribution in the pile structure.

According to the present invention, very homogeneous, secure and strong concrete pile structures, may be obtained and constructed with secured reinforced bars, and stamping of the concrete effected by vibration, may minimize gap and offer fineness and finally enable a strong pile structure.

What is claimed is:

1. A reinforced bar concrete pile construction apparatus for forming a reinforced bar concrete pile (CP), said apparatus comprising:

a tube rod (10) defining a hollow space and a grooved channel (12) inwardly and longitudinally formed along an outer wall thereof;

a bit (30) coupled to said tube rod (10);

an inner tube (17) concentrically disposed in said tube rod (10);

at least one projection (32) having an inclined surface for forming a diamond shape, said projection (32) positioned on said bit (30); and a plurality of triangle segments (34) positioned in a lower peripheral portion (31*a*) of said bit (30), said triangle segments (34) being hinge-jointed to an outer wall (31) of said bit (30).

2. An apparatus as set forth in claim 1 further including flanges (19), (19*a*) in which at least one through-hole (3*a*) is defined for securing said tube rod (10) and said bit (30).

3. An apparatus as set forth in claim 1 further including at least one door plate (14) which is pivotally hinge-jointed (15) at a right side of a tip portion of said grooved channel (12) for covering and retaining a concrete injection hose (13).

4. An apparatus as set forth in claim 3 further including at least one latch (16) attached at a left side of said tip portion of said grooved channel for opening and closing said door plate (14) over said grooved channel (12).

5. An apparatus as set forth in claim 1 further including at least one vibrator (33) positioned in an inner space of said projection (32).

6. An apparatus as set forth in claim 1 further including a plurality of lattices (18) connected to said inner tube (17) for concentrically positioning said inner tube (17) in said tube rod (10).

7. An apparatus as set forth in claim 1 further including an upper metal sheet cover (21) having pitted grooves (20) and an inclined surface extending from said outer wall of said tube rod (10).

8. An apparatus as set forth in claim 1 further including a lower metal sheet cover (21*a*) having pitted grooves (20*a*) and an inclined surface extending from an outer wall (31) of said bit (30), said bit defining a hollow space (30*a*).

9. An apparatus as set forth in claim 1 further including a metallic weight (36) having an outer peripheral surface and defining grooves (37) in said outer peripheral surface wherein said triangle segments (34) are engaged in said grooves (37).

10. An apparatus as set forth in claim 9 further including a hanger retaining tube (22) disposed in said tube rod (10).

11. An apparatus as set forth in claim 10 further including a hanger chain (2*a*) positioned within said hanger retaining tube (22) and connected to a coil spring (23) and a hook (24) wherein said metallic weight (36) is connected to said hanger chain (2*a*).

12. An apparatus for forming a reinforced bar concrete pile (CP), said apparatus comprising:

a hollow spaced tube rod (10) on which a grooved channel (12) is inwardly and longitudinally formed along an outer wall thereof;

an inner tube (17) concentrically fixed in said tube rod (10) and having the same length as said tube rod (10) and having fixed lattices (18) connected and welded between an outer tube (11) and said inner tube (17);

an injection hose (13) which is inserted and moved up and down in said grooved channel (12) to inject concrete;

at least one door plate (14) which is pivotally hinge-jointed at a right side of a tip portion of said grooved channel (12) for covering and retaining said injection hose (13);

at least one latch (16) which is attached at a left side of said tip portion of said grooved channel for opening and closing said door plate (14) along said grooved channel (12);

a hanger retaining tube (22) disposed between said outer tube (11) and said inner tube (17);

a hanger chain (2*a*) positioned within said hanger retaining tube (22) and connected to a coil spring (23) and a hook (24);

flanges (19), (19*a*) in which at least one through-hole (3*a*) is defined for securing said tube rod (10);

an upper metal sheet cover (21) having pitted grooves (20) and an inclined defining a hollow space (30*a*); surface extending from said outer wall of said tube rod (10);

a bit (30) coupled to said tube rod (10) by said flanges (19, 19*a*), said bit (30)

a lower metal sheet cover (21*a*) having pitted grooves (20*a*) and an inclined surface extending from an outer wall (31) of said bit (30);

at least one projection (32) having an inclined surface for forming a diamond shape, said projection (32) positioned on said bit (30) symmetrically therearound;

at least one vibrator (33) positioned in an inner space of said projection (32); and a plurality of triangle segments (34) adjacent to a lower peripheral portion (31*a*) of said bit (30), said triangle segments (34) being hinge-jointed to said outer wall (31) of said bit (30), and engaged in a metallic weight (36) in which grooves (37) are formed in an outer peripheral surface thereof, and which are connected to said hanger chain (2*a*).

13. An apparatus as set forth in claim 12 wherein lower end portions of said triangle segments (34) are engaged in said grooves (37) formed in said peripheral surface of said metal weight (36) for closing a lowest tip portion of said bit (30) and slidably opening the lowest tip portion just before a reinforced bar is descended and concrete is injected in soft-ground earth.

14. A process for forming a homogeneous concrete pile (CP), said process comprising the steps of:

driving a pile apparatus (1) into soft-ground earth by vibration of a vibrator (33) to a target level;

inserting reinforced bars (40) into an inner tube (17) of a tube rod (10) of the pile apparatus (1) in response to achieving the target level;

moving triangle segments (34) from a closed state to an opened state to allow the reinforced bars (40) to pass therethrough; and injecting concrete into the spaces formed in the soft ground earth by the pile apparatus (1) through an injection hose (13).

15. A process as set forth in claim 14 further including the step of drawing the pile apparatus (1) upwardly while vibrating the pile apparatus (1) so that the concrete is vibrated, filled and stamped around the reinforced bars (40) in the spaces formed by the pile apparatus (1).

16. A process as set forth in claim 15 further including the step of removing the pile apparatus (1) from the earth such that the homogeneous concrete pile (CP) with reinforced bar (40) is completely formed.

17. A process as set forth in claim 14 further including the step of drawing up a hanger chain (2*a*) through a hanger retaining tube (22) when the triangle segments (34) are released.

18. A process for forming a homogeneous concrete pile (CP), said process comprising the steps of:

descending a bit (30) of a pile apparatus (1) into soft-ground earth by vibration of a vibrator (33);

inserting reinforced bars (40) into an inner tube (17) of a tube rod (10) of the pile apparatus (1) in response to the bit (30) being descended to a target level;

pivotally moving triangle segments (34) to each side direction for releasing the triangle segments (34) from grooves (37) of a metallic weight (36) in preparation for receiving the reinforced bars (40);

drawing up a hanger chain (2*a*) through a hanger retaining tube (22) when the triangle segments (34) are released;

injecting concrete into the spaces formed in the soft ground earth through an injection hose (13);

drawing the pile apparatus (1) upwardly during successive vibration of the pile apparatus (1) so that the concrete is vibrated, filled and stamped around the reinforced bars (40) in the spaces formed in the soft-ground earth by projections (32) which are radially formed on the outer wall of the bit (30); and removing the pile apparatus (1) from the earth such that the homogeneous concrete pile (CP) with reinforced bar (40) is completely formed.

19. A concrete pile construction apparatus for forming a concrete pile (CP), said apparatus comprising:

a tube rod (10);

a bit (30) coupled to said tube rod (10) and having an outer wall (31) and a lower peripheral portion (31*a*); and a plurality of triangle segments (34) positioned near said lower peripheral portion (31*a*) of said bit (30) and hinge-jointed to said outer wall (31) of said bit (30).

* * * * *